United States Patent [19]

Hollweck et al.

[11] 4,059,817

[45] Nov. 22, 1977

[54] TEMPERATURE SENSITIVE SWITCH WITH SEPARATE BIMETAL AND HEAT TRANSFER MEANS

[76] Inventors: Walter Hollweck, Dormitzerstr. 3; Wilhelm Schnee, Franz Reichel Ring 16; Karlheinz Eberl, Dunanstrasse 33; Werner Basel, Am Steig 14, all of D-8500 Nurnberg, Germany

[21] Appl. No.: 642,567

[22] Filed: Dec. 19, 1975

[30] Foreign Application Priority Data

Dec. 21, 1974 Germany ..... 2460860

[51] Int. Cl.[2] ..... H01H 37/54

[52] U.S. Cl. ..... 337/365; 337/367

[58] Field of Search ..... 337/89, 91, 112, 348, 337/343, 367, 365, 380

[56] References Cited

U.S. PATENT DOCUMENTS

| | | | |
|---|---|---|---|
| 3,219,783 | 11/1965 | Odson | 337/348 |
| 3,297,845 | 1/1967 | Mertler | 337/380 X |
| 3,356,807 | 12/1967 | Brown et al. | 337/365 X |
| 3,832,667 | 8/1974 | Blanton | 337/348 X |

*Primary Examiner*—George Harris
*Attorney, Agent, or Firm*—Craig & Antonelli

[57] ABSTRACT

A temperature sensitive switch having a switch housing containing switch contacts and electrical leads, an arched bimetal disc, whose dome height changes under temperature influence, a guiding disc with a centrally located and freely moveable transfer pin, which transfers movements of the bimetal disc to the switch contacts, a potlike support, and a heat transfer plate placed between guiding disc and potlike support, and characterized by an opening at the bottom of the potlike container, to allow direct heat access to the heat transfer plate.

9 Claims, 4 Drawing Figures

TEMPERATURE SENSITIVE SWITCH WITH SEPARATE BIMETAL AND HEAT TRANSFER MEANS

The invention refers to a temperature sensitive switch instrument, for instance a thermostate or temperature limiting instrument, consisting of a housing which contains switch contacts and electrical connections, an arched bimetal disc whose dome height changes under temperature influence, a guiding disc in whose center a freely moveable transfer pin is resting which transfers the movement of the bimetal disc to the switch contacts, furthermore, consisting of a heat transfer plate made from highly heat conductive material and containing the bimetal disc, as well as a potlike container holding together housing, guide disc and heat transfer plate, whereby the heat transfer plate through an opening in the potlike container can directly be contacted by the area to be temperature controlled.

Similar thermostats are already known, contrary to this invention the potlike container features a closed flat bottom or, in order to mount the thermostat, a small threaded post.

This threaded post is usually riveted or welded to the bottom of the potlike container: a disadvantage since the heat will be transferred only through the post to the potlike container.

Other designs use a formed container, the post and pot being one part.

The bimetal disc rests within the potlike container (called the pot hereafter) on the bottom. By contacting the pot bottom with the area to be controlled the heat is transferred to the bimetal. Naturally, the one piece formed pot conducts the heat to the bimetal better than the welded design, especially, since the welding or riveting produces a loss of heat conductivity. Further disadvantages are the large mass, too much time is lost until the heat is transferred to the bimetal, and the high manufacturing cost of a formed part as in this particular case.

It is the task of invention to create a design of the pot which combines economic manufacturing and best possible heat conductivity from the surface to be controlled to the bimetal. This is achieved by creating a round opening in the bottom of the pot for the heat transfer plate, and designing it in a fashion that plate, guiding disc and switch housing can be held together.

The heat transfer plate can be designed as a flat plate or as a one piece part incorporating a threaded post of various length and diameter.

Materials can be utilized which have various co-efficients of heat conductivity. The advantage of this flexibility of the invention is that the same pot can be used for assemblies with different heat transfer plates. It is, therefore, conceivable to choose a material for the pot with higher mechanical stress properties than the materials with the good heat conductivity normally possess.

Another advantage of the inventive thermostat is the low manufacturing cost of both pot and heat transfer plate. The pot can preferably be formed by drawing sheetmetal and since the same pot is used for various designs the higher quantities lower costs even further.

The smaller mass of the heat transfer plate with threaded post compared with the previously mentioned pot is advantageous because the loss of time to transfer the heat to the bimetal is essentially smaller.

The heat transfer plate is cheaply manufactured if for the flat design it is punched out or, for the design featuring the threaded post it is cold headed. Coldheading is long known to be much cheaper than the conventional machining of the combination pot/threaded post.

The circumference of the heat transfer plate can also be designed in jagged fashion; one or more indents on the inside of the pot catch the recesses of such designed heat transfer plate. This will prevent any rotating movement of the completely assembled thermostat when it is installed. The described locking is important if the heat transfer plate with threaded post is applied.

Within the invention the heat transfer plate can be shaped to any desired profile, to accomodate a particular surface of the mounting area.

The invention is defined in more detail below, with reference to the following drawings, in which FIG. 1 is a section of thermostat in front elevation;

Figure 1:
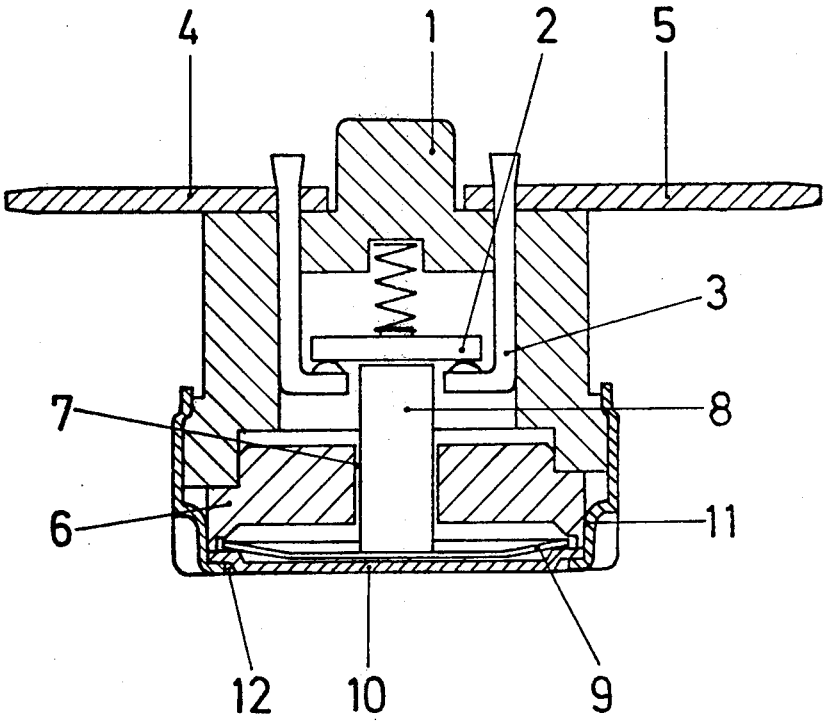

In FIG. 1, a housing 1 contains switch contacts 2 and 3 as well as the electrical leads 4 and 5. The guiding disc 6 is depicted with a centrally located bore 7 for the freely moveable transfer pin 8 which transfers the movement of heat sensitive bimetal disc 9 to the switch contacts 2. The bimetal disc 9 is centered in the heat transfer plate 10, made of good heat conductive material and, in this particular case, is designed as a flat plate.

The housing 1, the guiding disc 6 and the heat transfer plate 10 are held together by the potlike container 11, exhibiting an opening 12 at the bottom for free access to the heat transfer plate 10.

Figure 2:
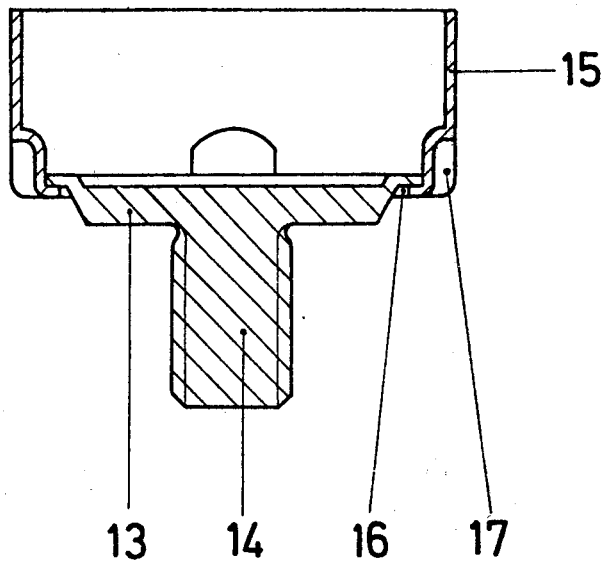
FIG. 2 is a sample design of a section of the heat transfer plate and pot.

FIG. 2, indicates the design of the invention, where the heat transfer plate 13 and the threaded post 14 are made as one part. The only other component shown is the potlike container 15 with the opening 16 at the bottom of it.

Figure 3:
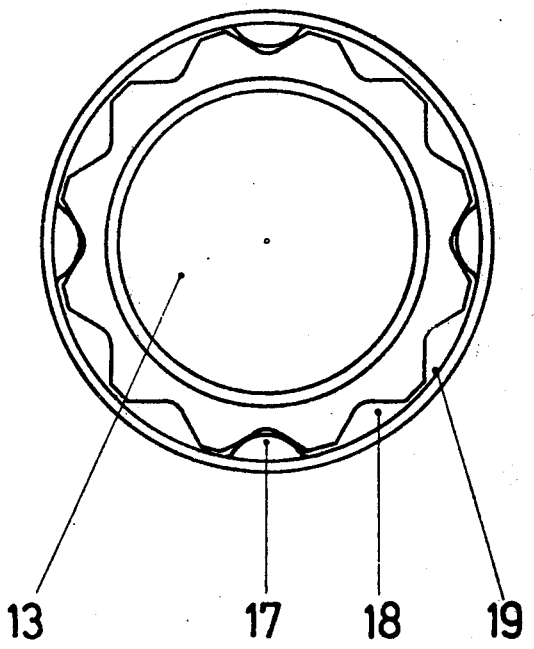
FIG. 3 shows in plan view a preferred design of heat transfer plate.

The preferred design of the heat transfer plate is shown in FIG. 3, and shows the jagged circumference 18 of the heat transfer plate 13. One or more indents 17 at the inside 19 of the pot 15 are located to catch the recesses of the heat transfer plate and prevent the independent rotation of the heat transfer plate 13. The indents 17 of the pot 15 can also be noticed in FIG. 2.

Figure 4:
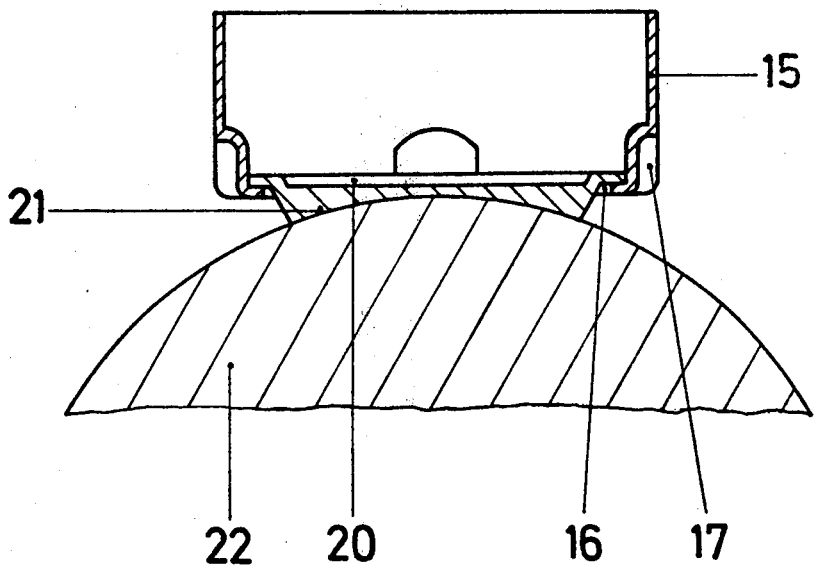
FIG. 4 is a section view in front elevation of an alternate design of heat transfer plate.

In FIG. 4, the heat transfer plate 21 is shown in contact with the bimetal disc 20, and passes through opening 16. The bottom of the heat transfer plate is shaped to conform to the surface of a heat conducting body 22.

In operation, heat passes primarily via the heat conducting plate to the bimetal disc, which reverses its curvature, lifting the post 8 (in FIG. 1). This separates the switch contacts causing a circuit to be opened.

The embodiments of the invention in which an exclusive property or privilege is claimed are defined as follows:

1. A temperature sensitive switch comprising :
   a. a switch housing containing at least a pair of switch contacts,
   b. an arched bimetal disc, whose dome height changes under temperature influence,
   c. a guiding disc with a centrally located and freely movable transfer pin, which transfers movements of the bimetal disc to at least one of said switch contacts to effect relative movement thereof with respect to said other contact, d. a potlike support mounted on said switch housing, and e. a heat transfer plate having predetermined heat transfer characteristics placed between guiding disc and said potlike support, and characterized by an opening at the bottom of said potlike support, to allow direct heat access to the heat transfer plate.

2. A temperature sensitive switch as defined in claim 1 wherein said heat transfer plate is a flat plate.

3. A temperature sensitive switch instrument as defined in claim 1, further comprising a threaded post extension on the heat transfer plate extending through the opening in said potlike support.

4. A temperature sensitive switch instrument as defined in claim 1, said heat transfer plate having a particular external conforming profile to an oppositely shaped surface to be temperature controlled.

5. A temperature sensitive switch instrument as defined in claim 3, wherein said heat transfer plate has a variably jagged circumference interlocking with one or more indents at the inside of the potlike support.

6. A temperature sensitive switch comprising a switch housing containing at least first and second switch contacts, at least one of said switch contacts being mounted for movement with respect to the other; a potlike support mounted on said switch housing and having an opening in the bottom thereof; a heat transfer disc having predetermined heat transfer characteristics disposed within said potlike support so as to form a cover for the opening in the bottom thereof, thereby providing direct heat transfer to said heat transfer disc from outside said potlike support; an arched bimetal disc supported on said heat transfer disc, the dome height of said disc changing with temperature; and transfer means including a transfer pin for transferring movements of said bimetal disc to said one switch contact.

7. A temperature sensitive switch as defined in claim 6 wherein said heat transfer disc has the shape of a cover and rests in the opening in the bottom of said potlike support.

8. A temperature sensitive switch instrument as defined in claim 6, further comprising a threaded post extension on the heat transfer plate extending through the opening in said potlike support.

9. A temperature sensitive switch instrument as defined in claim 8, wherein said heat transfer plate has a variably jagged circumference interlocking with one or more indents at the inside of the potlike support.

* * * * *